US005079533A

United States Patent [19]

Hed

[11] Patent Number: 5,079,533

[45] Date of Patent: Jan. 7, 1992

[54] MAGNETIC FLUX CONCENTRATORS AND DIFFUSERS

[75] Inventor: Aharon Z. Hed, Nashua, N.H.

[73] Assignee: International Superconductor, Riverdale, N.Y.

[21] Appl. No.: 334,584

[22] Filed: Mar. 21, 1989

[51] Int. Cl.[5] ..... H01F 7/22

[52] U.S. Cl. ..... 335/216; 338/325

[58] Field of Search ..... 335/216, 299; 174/125.1; 338/325; 505/1

[56] References Cited

U.S. PATENT DOCUMENTS 4,528,532 7/1985 Keim ..... 335/216
4,635,015 1/1987 Franksen ..... 335/216
4,868,707 9/1989 Takechi ..... 335/216 X
4,870,379 9/1989 Aihara et al. ..... 335/216 X

FOREIGN PATENT DOCUMENTS 0306287 3/1989 Japan ..... 335/216
0160065 6/1989 Japan ..... 335/216

*Primary Examiner*—George Harris
*Attorney, Agent, or Firm*—Herbert Dubno

[57] ABSTRACT

Switchable superconducting rings and hemi-rings positioned on the poles of magnets or electromagnets, are used to electronically concentrate magnetic fluxes, or to diffuse such fluxes within the space that is between such poles.

20 Claims, 3 Drawing Sheets

MAGNETIC FLUX CONCENTRATORS AND DIFFUSERS

CROSS REFERENCE TO RELATED APPLICATIONS

This application relates to my copending applications, Ser. No. 07/281/832 filed Dec. 8, 1988 entitled "Diamagnetic Colloids Containing Superconducting Particles"; Ser. No. 07/314,426 field Feb. 22, 1989 entitled "Electronic Modulation of Magnetic Fields"; and Ser. No. 07/314,427 field Feb. 22, 1989 entitled "Switchable Superconducting Elements and Pixels Array".

FIELD OF THE INVENTION

The instant invention is in the field of electronic modulation of magnetic fields.

BACKGROUND OF THE INVENTION

Let us consider the two opposing poles of a magnet or an electromagnet. Except near the rim of the poles the magnetic field between the poles can be considered to be relatively homogeneous and unidirectional. In the prior art, the shape and intensity of such a field between poles could be manipulated only by the introduction of ferromagnetic materials as extensions of the poles, and the final shape of the field would be a strong function of the morphology of these add on pieces. This required that for each new configuration a different set of pole extensions with appropriate geometries be designed and mounted on the magnet poles. If the magnet was an electromagnet some control of the field intensity (but not shape) could be achieved by passing more or less current through the windings of the electromagnet. This could be achieved either by controlling the current through the windings (continuous change) or by using a number of independently powered coils and choosing the number of coils powered simultaneously to increase or decrease the field intensity (discrete change).

In a co-pending application entitled "Electronic Modulation of Magnetic Fields" I have described the principles of using switchable superconducting inserts in the geometry of existing magnetic fields to modify the flux distribution of the magnetic field in the vicinity of said inserts. In another co-pending application entitled "Switchable Superconducting Elements and Pixels Arrays" I have described how in an array of superconducting elements (supels) we can selectively switch into the normal phase any set of supels to create a desired pattern in which some of the supels are in the normal state and some are superconducting.

In the present invention similar devices and methods are used to obtain concentration and diffusion of existing magnetic field flux between the poles of a fixed magnet or an electromagnet.

Such devices are very useful in the art of magnetic separation, particularly when repeated sweeping of a magnetic field toward a center is desired, or when repeated sweeping of a magnetic field to the edge of a field configuration is required.

In the medical field, such devices can be used to modulate magnetic field in MRI diagnostic systems. Such devices can also find uses in the art of localized drug delivery systems and particularly localized oncological chemotherapy as magnetic field barriers and drug concentrators when using paramagnetic or diamagnetic drug carriers as well as in specialized immunoassay techniques.

These devices can be operated with existing superconductor technology at cryogenic temperatures.

The devices are not intended to operate near the limits of magnetic field strength of the superconductors involved, therefore very high current density capabilities of the superconductor used are not a major prerequisite.

OBJECTS OF THE INVENTION

It is an object of my invention to provide improved means of concentrating the magnetic flux between the poles for a magnet or electromagnet by electronic means.

It is another object of this invention to provide improved means for lowering the concentration of magnetic flux between the poles of a magnet or an electromagnet.

It is yet another object of this invention to modify the morphology of the magnetic flux between the two poles of a magnet in a controllable way.

SUMMARY OF THE INVENTION

These objects are attained in accordance with the invention in that at least on one of the two poles of a magnet a number of concentric superconducting elements are fastened, each superconducting element having means to switch it from the superconducting state to the nonsuperconducting state, and thus modifying the magnetic flux between said poles by the variation in the Meissner effects through said elements. By choosing an appropriate morphology of said elements as well as an appropriate schedule of switching in and out of the superconducting phase, different types of magnetic fields can be obtained. The configurations provided in the present invention and the methods of operating said configurations are such that temporal and spatial modulation of the flux between the magnet poles can be obtained.

BRIEF DESCRIPTION OF THE DRAWING

The above objects, features and advantages of my invention will become more readily apparent from the following description, reference being made to the accompanying drawing in which.

SPECIFIC DESCRIPTION

The implementation of my invention involve elements that are inserted, usually in opposing pairs between the two poles of a permanent magnet or an electromagnet. While the poles of said magnets are not necessarily parallel to each other, nor even necessarily of the same size or shape, for the purpose of this description I have assumed that the two poles are circular and opposing each other. It should be self evident that the devices described herein can be implemented with magnet poles having other shapes and that a simple topological transformation from the circular symmetry described herein to any normal pole morphology is straight forward and would result in qualitatively (while not always quantitatively) similar changes in magnetic field flux modifications. We term in the following, the structures containing the switchable superconducting elements responsible for the magnetic flux modifications "superconducting pole inserts assembly" or for short "assembly" or "insert".

Figure 1A:
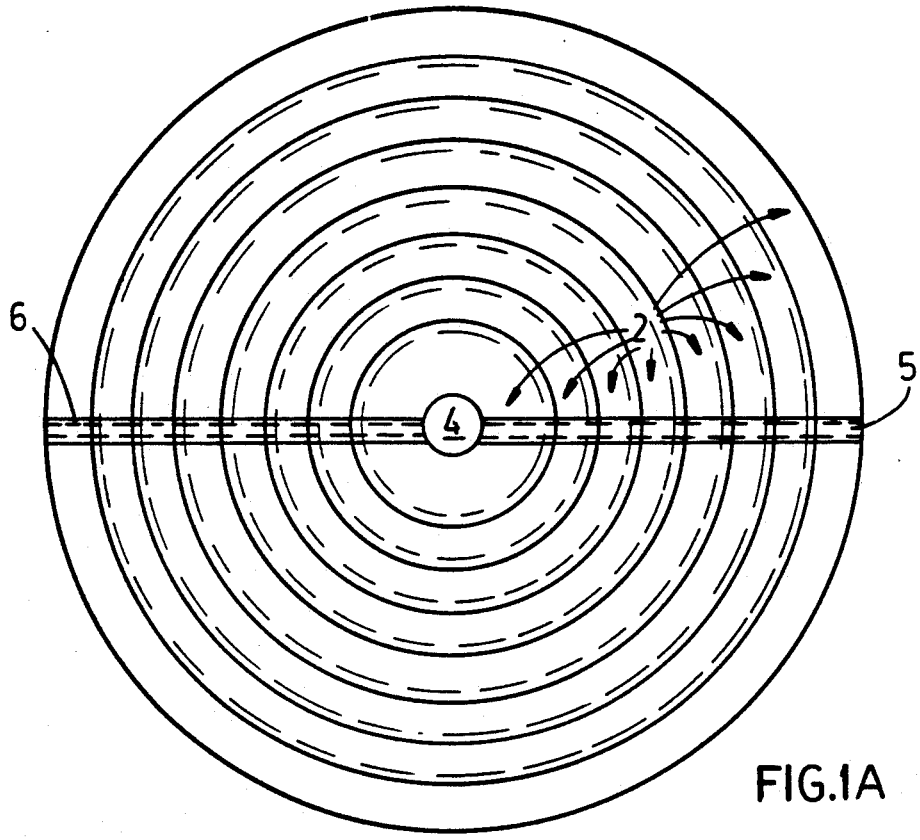
FIGS. 1A and 1B are, respectively, a top view and a cross section through an assembly of switchable superconductor elements capable of providing magnetic field concentration.
Figure 1B:
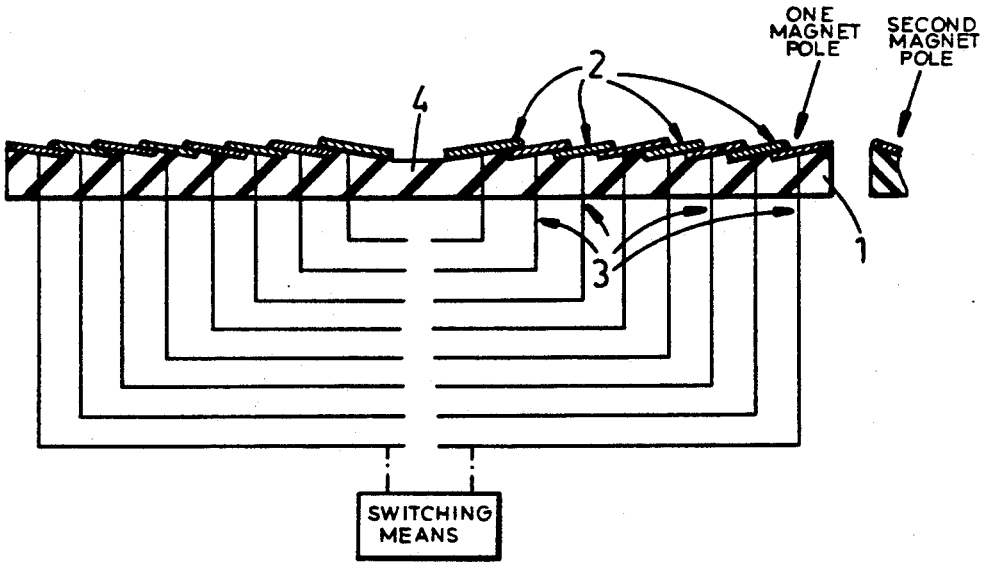

FIG. 1A is a top projection of a superconducting pole insert and FIG. 1B is a cross section through the same assembly.

The substrate (1) of the assembly should preferably made of an insulating material. The top surface of this substrate has a number of slanted concentric steps, the outermost step being of a width slightly larger than that of the inner steps. The height differential between the high part of these concentric step and the low part of the step determines the thickness of the superconducting hemi-rings (2) deposited on the substrate (1). While FIGS. 1A and 1B show the hemi-rings overlying one another, it should be understood that in the space separating two adjacent concentric rings, an insulating layer is deposited, so as to assure electrical isolation between concentric hemi-rings. This isolating insulating layer should therefore be thicker than a layer through which Josephson (or quasiparticle) tunneling is possible (see also FIGS. 3, 4 and 5).

Each hemi-ring, has electrical connections (3) attached to their respective ends to allow for current passage through the hemi-rings. The center (4) of the structure in FIGS. 1A and 1B is left without a superconducting layer.

The superconducting hemi-rings, which are actually full circular rings that have a gap (5) which is not superconducting, can be switched in and out of the superconducting state in manners similar to these described in a co-pending application entitled "Switchable Superconducting Elements and Pixels Arrays", except that in the present embodiment, one may chose to consolidate the priming and switching currents in a single current, carried by the leads (3). It should be understood that each hemi- ring has its own two leads for that purpose, connected at the termination of the hemi-rings, or adjacent to the gap (5).

The strip (6), is an optional overlay of superconductor over the insulating gaps (5) and covering the termination of the superconducting hemi-rings. This superconductor is also isolated electrically from all the superconductor hemi-rings it overlies.

Let us not consider the assembly as described herewith to be fastened to one of the poles, and another assembly essentially the mirror image of the one described here, fastened on the other pole.

If all the superconductors in both superconducting inserts are in the normal state (being switched by currents supplied through the leads (3)), then the flux distribution will be the same as without the superconducting inserts.

Let us consider first the situation where the superconducting overlays (6) are not present or are independently switched to the normal state.

Let us assume now that the two outer hemi-rings in each of the two opposing assemblies are allowed to return to the superconducting state. The magnetic field will be excluded from the now superconducting ring, with some of the field forced out of the outer rim and some of the flux being forced within the inner space of the two outer rings, thus increasing flux density in the center area within the outer ring. (In this discussion we purposefully simplify the actual mechanism of field exclusion which involves the creation of persistent currents within the superconductors so as to negate magnetic flux density within the superconductor but as a result an increase in flux density outside the superconductor is achieved, and discuss only the apparent results of magnetic field exclusion in the specific superconductor:morphologies that are the essence of the present invention).

In the gap (5) between the two rings, we also have a magnetic field concentration.

If we now allow an additional adjacent inner ring to return to the superconducting state, the flux concentration in the circle within this last ring will further increase. If the overlap between the two rings is well designed, only minimal leakage of magnetic field between the two adjacent half rings will be present, and the majority of the flux that occupied the circle created by the outer ring will be concentrated within the circle created by the second ring. If we continue switching back to the superconducting state consecutive adjacent rings, we will obtain concentration of essentially all the magnetic field flux that occupied the circle defined by the pole's surface to the circle (4) which is devoid of any superconducting overlay, and the narrow gap (5).

It should be mentioned here that if we did not introduce the gap (5), or used full superconducting rings, then all the flux would be pushed outside the outer rim of the superconductor, since the rings would have formed singly connected regions, within which, at least under perfect conditions, the field is excluded. The switching of additional inner full rings after the outer ring has returned to the superconducting state would have no additional impact on the field morphology. Below we discuss such full ring structures where the order of switching is reversed.

Let us now assume that the superconducting overlays (6) above the four respective gaps (5), are in place and superconducting at all time (the situation described above could of course be obtained from this one by switching these overlays to the normal phase). When the hemi-rings are in the normal state, we simply have a slight increase in magnetic flux density outside the overlays (6) and no magnetic flux in the overlay.

The effect of these overlays on the field morphology when the hemi-rings return to the superconducting state is thus simply to eliminate the line (actually, partially eliminate since we always have leakage through the insulation separating the different superconductors electrically from each other) of magnetic flux that was present in the prior description, thus creating more perfect circular concentration of the magnetic field when consecutive hemi- rings are switched back to the superconducting state.

The description of magnetic flux field distribution in the last few paragraphs is accurate within the plane containing the superconducting elements and slightly above them. If the superconducting inserts described herein are activated and deactivated simultaneously on both poles of the magnet, then the description given above will apply equally to any plane parallel to the poles, except as we approach the center of the gap (in a direction perpendicular to the poles surfaces, assuming the two poles to be parallel) we can have some weakening of the concentration effect (or the flux lines will be curved slightly with maximum deviation from the vertical at the mid point between the poles), nevertheless, a distinct concentration of magnetic field will occur when all the rings are in the superconducting state in an oblong space connecting the two surfaces (4) that are not covered with a superconducting element. The extent of widening of the space into which the flux is concentrated, is a strong function of the dimensions of the gap, the larger the distance between the poles, the broader is the oblong space into which the magnetic flux is concentrated.

The device herein described can control by electronic means the magnetic field intensity at least in the area marked (4) between the two poles of a magnet or an electromagnet.

In many magnetic separation and concentration applications the accidental magnetic field gradient present near the inner part of the wider superconducting ring is also of great importance, and particularly the fact that this configuration can be swept toward one area (the center) when the rings are switched back to the superconducting state in a temporal sequence. This device can be used for instance to separate or concentrate to space between the centers of the pole superparamagnetic particles from biological solutions.

It should not be construed that the devices described herein provide for regions outside the oblong space between the circles (4) (and extensions of that circle when subsequently larger hemi-rings are switched to the normal state) that are absolutely devoid of magnetic flux. The main applications for these devices will involve differences in field intensity, rather than complete field exclusion. One source for such residual fluxes, could be the fact that the superconductor hemi-rings are in the type II state, thus not providing complete Meissner exclusion. Another source of such residual flux would be flux pinning run the superconductors. Yet another source of residual flux could be magnetic field leakage between the rings through the insulation between adjacent hemi-rings.

It should also be mentioned that the order of switching the superconductor hemi-rings back and forth, and in the case of an electromagnet, the existence or lack thereof of the magnetic field during switching, will all have an impact on the exact nature of the resulting field topology, when using the new high temperature superconductors which all exhibit at least some degree of magnetic hysteresis.

When the requirements for changing the magnetic field from one topology to another, is for slow rates of change, or in steady state configurations, one does not necessarily need to rely on switching the hemi-rings with switching currents. Instead, the substrate under the superconducting hemi-rings could be equipped with appropriate microheating elements and cause the switching between the superconducting and normal state to occur either thermally or by a combination of thermal and current switching, the local increase in temperature in the region that need be switched being the priming event and the current used only for final switching. This and other switching techniques have been described in the co-pending application entitled "Electronic Modulation of Magnetic Fields".

It should also be understood that the devices described herein will usually be used with magnetic fields that are at least an order of magnitude lower than the critical field of the superconductors comprising the hemi-rings, so as to assure that accidental switching to the normal state is not induced by the field which we are modifying. Therefore, the maximum field flux concentration one can obtain with the proposed devices should not exceed the critical field of the superconductor at the temperatures which the superconductor hemi-rings are intended to operate.

The substrate thickness is optimized to limit the space occupied by the inserts (minimizing thickness) and by the factor that high magnetic field fluxes are forced to be concentrated within the substrate as the rings and hemi-rings are switched to the superconducting state. The thickness of the substrate should be large enough so that these fluxes do not exceed the critical fields of the superconductors utilized. This of course depends directly on the magnetic field of the magnet.

It should be clear to persons trained in the art that the specific structure and layout of the superconducting rings described herein can be replaced with various different superconducting hemi-rings or rings deposited or assembled in a form to yield essentially the same topology.

It should also be clear to a person trained in the art that the poles described herein do not have to be necessarily parallel to each other for the application of superconducting inserts as described. Such insert will have similar impact on flux distribution with poles that form an angle between them as for instance in "horseshoe magnets".

A number of techniques can be used to optimize current utilization in the switching scheme of the inserts and their parts. This could include using the same current for rings in opposing inserts, designing the rings with similar cross sections, using the same for a multiplicity of rings. One should be careful in the design of such circuits not to create inadvertently from a number of separated segments, a singly connected ring in the superconducting state. This situation could easily happen if, the leads themselves are superconducting and no consideration to the topologies created by the ring segments and their leads is given.

Figure 2A:
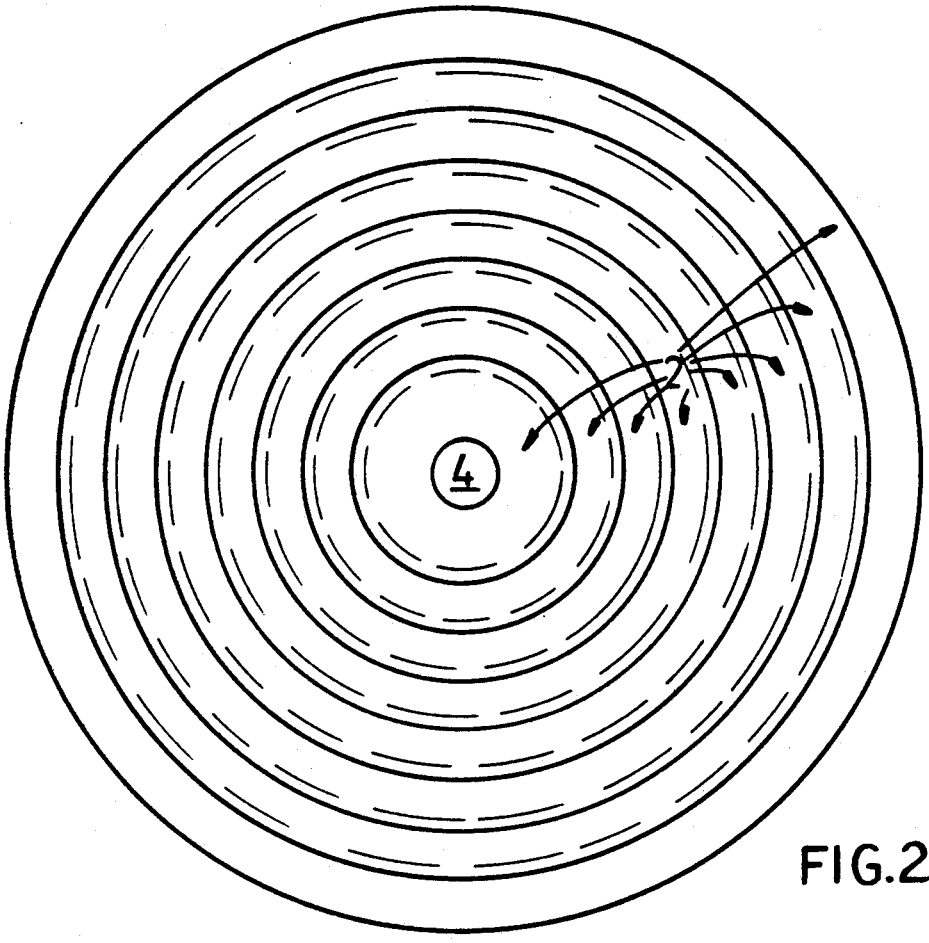
FIGS. 2A and 2B are, respectively, a top view and a cross section of such an assembly designed to provide magnetic field diffusion.
Figure 2B:
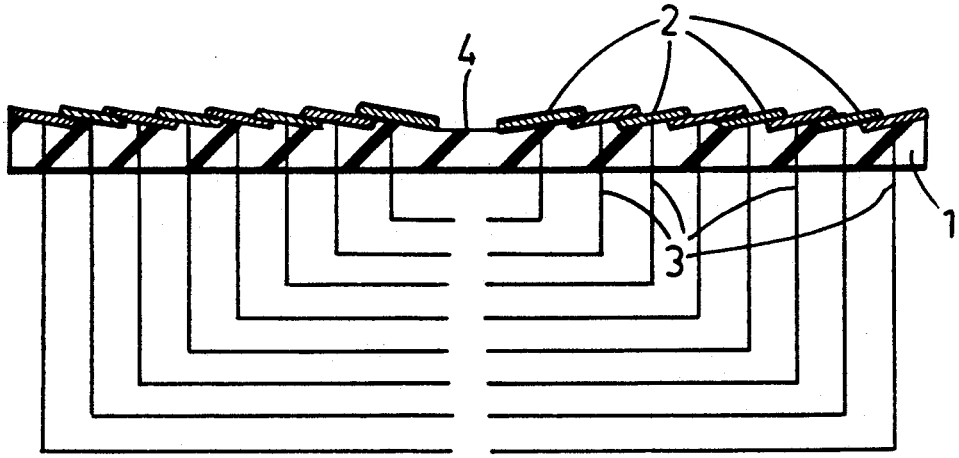

Let us now consider FIGS. 2A and 2B , where the gap (5) that was present in FIG. 1A has been eliminated, and we now have concentric superconducting rings. The magnetic field flux will be forced to the rim of the poles, when the superconducting ring are in their superconducting state. Switching any inner ring into the normal state will have no effect on flux distribution as long as the outer ring is superconducting. Therefore, the operation mode is to switch the rings to the superconducting state from the inside ring out obtaining successively larger area in which the magnetic flux has been lowered (or diffused magnetic fields). It should be self evident, that once a nth ring is superconducting, the status of an mth ring with a smaller radius than the nth ring is irrelevant. Of course, one may want to leave all such rings within a superconducting ring in the same superconducting state (to avoid the current or thermal demand to keep it normal).

This configuration is particularly useful when one wants to concentrate in the center diamagnetic particles in a magnetic separation device.

EXAMPLES

Figure 3:
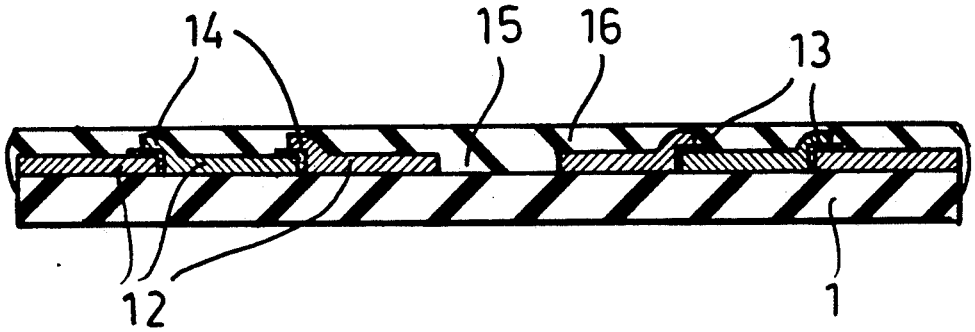
FIGS. 3–5 are cross-sectional views which are additional examples of the implementation of the two general devices that are the subject of the present invention.

A planar Configuration where all the superconducting element are in the same plane is another example for field modifying inserts. A cross section through such an insert is shown in FIG. 3, where we show a flat substrate 1 of 2" in diameter (1) on which superconducting rings (12) are deposited the outer ring first (for instance 123 by techniques described in a co-pending application entitled "Switchable Superconducting Elements and Pixels Arrays"). The inner corner of such ring is now coated with a small and narrow insulation layer (13), for instance diamond like carbon, (shown dark) to provide electrical isolation between the rings, and the next (inner) ring is now deposited with an overlap (14) above the edge of the prior ring. The inner circle (15) is left free of any superconductor deposit and the assembly is now covered with an insulation (16). While The specific dimensions in FIG. 3 show very large aspect ratio in the rings (thickness about 3000 angstroms and width of each ring about 7 mm), because the application did not require high density of superconducting elements. It should be evident that with appropriate driving electronics, a high density of elements can be implemented in a manner similar to the techniques taught in the co-pending application entitled "Switchable Superconducting Elements and Pixels Arrays"). The width of each ring can be as small as 50 microns, thus having 20 elements per millimeter, and creating an almost continuous sweep of the magnetic field when the rings are sequentially allowed back into the superconducting state.

Figure 4:
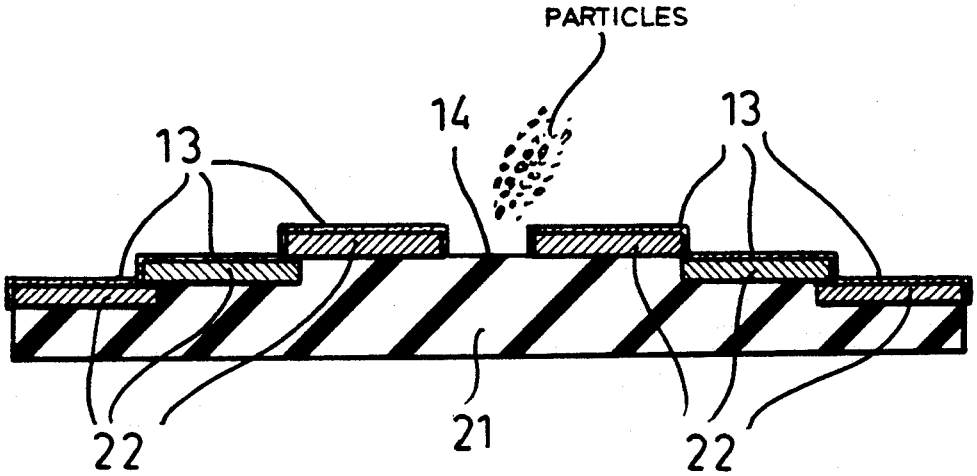
Figure 5:
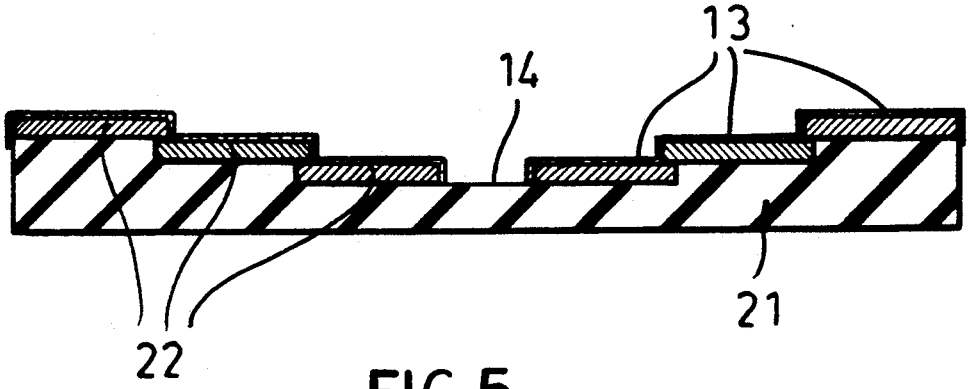

In FIG. 4 and FIG. 5, we show assemblies with slightly different morphologies but an essentially equivalent topology. In FIG. 4, the substrate (21) has ascending circular steps on which superconducting rings (22) are deposited, first on the outer step, followed by a first insulation on top of the superconductor, then the second superconducting ring is deposited, overlaying the first ring as described above. In FIG. 5, essentially the same design is practiced, except that the steps are descending toward the center of the pole, and consequently, the inner ring is deposited first.

Elements as described in FIG. 1A and 1B are built except that the gap structure or the line connecting the gap between all opposing elements on an insert, is designed to form to topologically equivalent forms to that described in FIG. 1A and B, including but not limited to, a protruding rim in the substrate structure, an area simply devoid of superconductor deposition without specific structures in the substrate or any other means yielding essentially a gap between the two hemi-rings.

In some applications it is desired to obtain a line with high magnetic field flux density as created by the gap (5) in FIG. 1A and B, when the overlay strip is absent or switched into the normal state. Further more, in some other applications, such a line may not necessarily need be a straight and diametrical line. It should be clear to persons trained in the art, that any line that will topologically form from the rings two or more segments that are not simply connected can be designed, thus forming in that line (connecting all the gaps), or in the multiplicity of lines (when more than two segments per ring are created) a high flux concentration.

Such unique lines of high field flux where they serve as "magnetic field barriers" in diamagnetic colloid based devices and applications (see a co-pending application entitled "Diamagnetic Colloids Containing Superconducting Particles).

SPECIFIC EXAMPLE

In the field of magnetic immunoassays, superparamagnetic particles of very small dimensions are often used as carriers for biological substances that interact with specific antibodies in a serum to be diagnosed for said antibodies. It is required to separate these particles from their natal solutions once the interaction has taken place, and concentrate these superparamagnetic particles for further analysis. This technique has been difficult to automate due to the length of time it takes to separate the particles from their natal solutions and difficulty in applying a sweeping magnetic field gradient resulting in the concentration of said particles in the center of the vessel where they can easily be collected by aspiration.

This problem is solved with a small 2" diameter electromagnet having a field strength of 0.1 Tesla (only 1000 Gauss) with a gap of 1.25". An assembly consisting of two inserts as described in FIG. 3, is built. The substrate is a hollow double wall (except the top circle which is single wall) stainless steel disk, 2" in diameter and about 5 mm thick on which a thin layer of 1000 Angstrom diamond like carbon is deposited (see copending application entitled "Switchable Superconducting Elements and Pixels Arrays"). The hollow have means to cools the substrate to liquid nitrogen temperature (two tubes, one open and terminated vertically with a venting orifice and the other connected to a liquid nitrogen supply).

On the first diamond like carbon layer we deposit first the outer superconducting ring of 123 superconductor about 3000 angstrom thick and about 7 mm wide (two half rings with a gap of about 2 mm). This is followed by another 1000 angstrom of diamond like carbon. The two inner rings are similarly deposited with a thin diamond like carbon between the successive superconducting rings. An uncoated circle about 8 mm in diameter is left in the center. The gap between the hemi-rings is then covered with another 123 superconducting layer (3000 angstrom thick) and covering the hemi-rings edges with about 0.5 mm overlap, but not the assembly's center. And once more, a diamond like carbon insulation is plasma deposited on the whole surface.

Twelve current silver leads are silvered (silver paste), two each on each of the six superconducting segments, after plasma etching back the diamond like carbon coating in the center of the hemi-rings opposing the gap, all the way to the superconducting element.

The assembly is now coated with a thin epoxy layer to facilitate its handling. A second assembly mirroring the first is prepared in the same manner for the second pole.

The sides of the assemblies facing each other are covered with a 4 mm thick mating polystyrene foam to prevent excessive heating of the assemblies from the sample holder which is at ambient temperature.

In the residual gap, which is about 0.5", a flat circular separator is positioned. The separator consists of a 2" in diameter hollow and flat cylinder (about 1 cm high) having opposing entry and exit tubes for the natal solution, and a third central and axial perforated tube, about 3 mm in diameter serving as an aspirator.

The operation of the device is straight forward. The assemblies are cooled with liquid nitrogen, and an aliquot of the natal solution is allowed in the separator. Since there is a magnetic field maxima in the central region surrounding the aspirator, the superparamagnetic particles are starting to move in the direction of the center. That movement, however, is relatively slow. We quench all three superconducting pairs of hemi-rings in both assemblies into the normal state, and immediately allow the outer pairs of elements back into the superconducting state, then the middle pairs and then the inner pairs. The delay between the start of the separate activations is about 25 milliseconds, so that once a second the magnetic field is swept 10 times from the outside to the center. After about 10 seconds (or one hundred sweeps), most of the superconducting particles are concentrated in the central part of the separator and aliquot from the center is aspirated with the aspirator, containing a majority of the superparamagnetic particles. It should be clear that for very small samples narrower gaps and smaller poles could be used in a similar manner.

It is understood that the above described embodiments of the invention are illustrative only and modifications and alterations thereof may occur to those skilled in the art. Accordingly, it is desired that this invention not be limited to the embodiments disclosed herein but is to be limited only as defined by the appended claims.

I claim:

1. An apparatus for reversibly concentrating a magnetic flux between two poles of a magnet to only part of a space between said poles, said apparatus comprising:

a set of switchable superconductive elements centrally positioned on one of said poles and electrically insulated therefrom, said set of elements comprising at least two opposing superconductive ring segments separated by nonsuperconducting gaps and means for switching said elements between superconductive and nonsuperconductive states.

2. The apparatus defined in claim 1 wherein a respective one of said sets is positioned on each of said poles and both of said sets have their gaps disposed opposite one another.

3. The apparatus defined in claim 1 wherein said set is formed with a multiplicity of coaxial superconductive ring segments disposed coaxially and electrically insulated from one another to form the elements of said set, said set being free from superconducting elements at a center of said one of said poles to form a region of flux concentration at said center when all of said elements are switched to the superconducting state.

4. The apparatus defined in claim 1 wherein said means for switching said elements includes means for passing through said elements selectively electric currents greater than the critical current in the field of said magnet of the respective superconductor element.

5. The apparatus defined in claim 1 wherein said means for switching said elements includes means for raising the temperature of said elements selectively above a critical temperature in the field of said magnet of the respective superconductor element.

6. The apparatus defined in claim 1 wherein said poles and said set are circular.

7. The apparatus defined in claim 1 wherein said poles and said set are noncircular.

8. The apparatus defined in claim 1 wherein said elements substantially conform topographically to the shape of said one of said poles.

9. The apparatus defined in claim 3 wherein adjacent ones of said elements partly overlap one another.

10. The apparatus defined in claim 3 wherein gaps between opposing ones of said ring segments define a predetermined curve, a respective one of said sets being positioned on each of said poles and both of said sets having the predetermined curves of their gaps disposed opposite one another, whereby a magnetic flux concentration occurs between said curves when all of said superconducting elements are in the superconducting state.

11. The apparatus defined in claim 10, further comprising an additional superconducting element deposited over at least one of said gaps between opposing segment of a respective one of said poles and electrically insulated from said ring segments.

12. A method of generating a spatially and temporally variable magnetic field between opposing poles of a magnet, comprising the steps of:

(a) disposing on each of said poles a respective set of switchable superconductive elements centrally positioned on the respective pole and electrically insulated therefrom, each of said sets of elements comprising substantially concentric arrays of opposing superconductive ring segments separated by nonsuperconducting gaps; and (b) switching said elements between superconductive and nonsuperconductive states.

13. The method defined in claim 12 wherein all of said elements are initially quenched into the nonsuperconducting state and then the elements are caused to return to their superconducting states in a predetermined sequence.

14. The method defined in claim 13 wherein said predetermined sequence has an outer pair of said ring segments of one of said sets on a respective one of said poles return to the superconductive state and then successively more inwardly disposed pairs of ring segments return to the superconductive state until all of the elements of the respective set are in the super-conductive state.

15. The method defined in claim 12, further comprising the steps of:

disposing magnetic particles in a space between said poles; and concentrating said particles at a region between centers of said poles by controlling the switching of said elements between said states so as to repeatedly sweep said magnetic field toward said region.

16. The method defined in claim 13 wherein all segments of a given ring form a continuous superconductor, and wherein predetermined sequence has an innermost pair of said rings of one of said sets on a respective one of said poles return to the superconductive state and then successively more outwardly disposed pairs of rings return to the superconductive state until all of the elements of the respective set are in the superconductive state.

17. An apparatus for reversibly diffusing a magnetic flux between two circular poles of a magnet toward an outer rim of said poles, said apparatus comprising:

at least one set of switchable superconducting elements in the form of a ring on one of said poles electrically isolated from said one of said poles; and means for switching said elements between superconductive and nonsuperconductive states.

18. The apparatus defined in claim 17 wherein a respective one of said sets is positioned on each of said poles.

19. The apparatus defined in claim 18 wherein each set is formed with a multiplicity of coaxial superconductive rings disposed coaxially and electrically insulated from one another to form the elements of said set.

20. The apparatus defined in claim 19 wherein adjacent ones of said elements partly overlap one another.

* * * * *